US011371266B2

(12) United States Patent
Lin

(10) Patent No.: US 11,371,266 B2
(45) Date of Patent: Jun. 28, 2022

(54) CHAIN LOCK

(71) Applicant: Yu-Pin Lin, Tanan (TW)

(72) Inventor: Yu-Pin Lin, Tanan (TW)

( * ) Notice: Subject to any disclaimer, the term of this patent is extended or adjusted under 35 U.S.C. 154(b) by 318 days.

(21) Appl. No.: 16/822,021

(22) Filed: Mar. 18, 2020

(65) Prior Publication Data

US 2021/0293056 A1 Sep. 23, 2021

(51) Int. Cl.

| | |
|---|---|
| ***E05B 73/00*** | (2006.01) |
| ***E05B 67/00*** | (2006.01) |
| ***E05B 67/24*** | (2006.01) |
| ***E05B 67/36*** | (2006.01) |

(52) U.S. Cl.

CPC ..... *E05B 73/0005* (2013.01)

(58) Field of Classification Search

CPC .... E05B 73/0005; E05B 67/003; E05B 67/24; E05B 67/36; Y10T 70/40; Y10T 70/409; Y10T 70/435; Y10T 70/483; Y10T 70/5009; Y10T 70/5872; Y10T 70/7576

See application file for complete search history.

(56) References Cited

U.S. PATENT DOCUMENTS

| | | | | |
|---|---|---|---|---|
| 11,053,712 | B2 * | 7/2021 | Lin | E05B 67/003 |
| 11,286,690 | B2 * | 3/2022 | Ramakrishna | E05B 37/025 |
| 2014/0060126 | A1 * | 3/2014 | Stevens | E05B 73/00 70/35 |
| 2015/0211263 | A1 * | 7/2015 | Bullwinkel | E05B 21/06 70/344 |

* cited by examiner

*Primary Examiner* — Lloyd A Gall

(57) ABSTRACT

A chain lock includes a top part pivotably connected to a bottom part. An engaging member is located in the bottom part. A lock cylinder, a rotary member and a rod are connected to each other. A torsion spring is biased between the lock cylinder and the rotary member. The torsion spring, the lock cylinder, the rotary member and the rod are located in a movable member to which a compression spring is mounted. Both of the movable member and the compression spring are received in the top part. A chain is secured in a first radial slot of the top part by the movable member, and the other end is inserted in the second radial slot of the bottom part. The chain lock is locked without using the key, and the key is required to unlock the chain lock.

3 Claims, 10 Drawing Sheets

CHAIN LOCK

BACKGROUND OF THE INVENTION

1. Fields of the Invention

The present invention relates to a chain lock, and more particularly, to a chain lock which is locked without using a key, and the chain lock is unlocked by using a correct key.

2. Descriptions of Related Art

The conventional chain lock is used to secure an object to a fixed body, for example, to secure a bicycle to a post. The chain has one end connected with a lock, and the lock is able to be connected to the other end of the chain. Generally, the lock is a combination lock or a padlock. However, the chain and the lock are two individual parts, once either one of the two parts is lost, the chain lock cannot function as expected.

A conventional chain lock known to applicant is disclosed in FIGS. 1 and 2, and includes a body 10 which has a first slot 100 and a second slot 101. A compression spring 11 and a lock cylinder 12 are received in the body 10. The lock cylinder 12 has a rod 13 inserted from the bottom thereof and the lower end of the rod 13 is movably inserted into the second slot 101. A chain 14 has one end thereof fixed in the first slot 100 by a pin, and the rod 13 extends through the other end of the chain 14 and then the rod 13 is secured in the second slot 101 to form the locked status of the chain lock. Although the chain 14 and the body 10 are combined to prevent being lost, the first and second slots 100, 101 in the body 10 are located opposite to each other and not adjustable, so that the chain 14 may not be conveniently to be connected to the second slot 101. Besides, a key has to be used to rotate the lock cylinder 12 whenever the user wants to lock or unlock the chain lock.

The present invention intends to provide a chain lock that eliminates the shortcomings mentioned above.

SUMMARY OF THE INVENTION

The present invention relates to a chain lock and comprises a top part having a room defined in the top end thereof. At least one guide slot and at least one positioning slot are respectively defined axially in the inner periphery of the room. A bottom hole is defined in the bottom end of the top part and communicates with the room. A first radial slot is defined through the wall of the top part and communicates with the bottom hole. A flange is formed to the bottom end of the top part. A bottom part is pivotably connected to the bottom end of the top part. A passage is defined axially through the bottom part. A second radial slot is defined through the wall of the bottom part and communicates with the passage. A rib is formed to the top end of the bottom part, and the flange of the top part is engaged with the rib. A lip extends radially and inward from the inner periphery of the passage and is located corresponding to the inside of the second radial slot.

An engaging member is located in the passage of the bottom part and has a recess defined in the top thereof. A first annular groove is defined in the inner periphery of the recess. A bottom member is connected to the bottom end of the bottom part. The bottom member has a reception area defined in the top thereof. A movable member is located in the room of the top part and extends through the bottom hole and the passage. The movable member has a head and a tubular portion which extends from the head. The head has a chamber defined in the top end thereof. A second annular groove is defined in the inner periphery of the chamber. A first aperture and a first radial hole are defined through the wall of the head. A positioning pin is inserted in the first aperture. A first bead is located in the first radial hole. The tubular portion has an axial hole defined therein which communicates with the chamber. Two second radial holes are defined through the wall of the tubular portion and communicate with the axial hole. Two second beads are respectively located in the two second radial holes.

A compression spring is mounted to the tubular portion of the movable member and located in the room of the top part. A lock cylinder is located in the chamber of the tubular portion of the movable member. A driving portion extends from the bottom end of the lock cylinder and a bottom room is defined in the bottom end of the driving portion. An elongate hole is defined radially through the wall of the driving portion. A fixing pin is inserted into the elongate hole. The lock cylinder has a first insertion hole defined in the bottom end thereof. A keyhole is defined in the top end of the lock cylinder. A C-clip is mounted to outside of the lock cylinder. A rotary member is attached to the bottom end of the lock cylinder and has an axial hole in which the driving portion of the lock cylinder is inserted. The rotary member has a curved recess defined in the outside thereof. A second aperture is defined radially through the wall of the rotary member and communicates with the axial hole. The fixing pin extends through the second aperture. A second insertion hole is defined axially in the rotary member. A torsion spring is located between the lock cylinder and the rotary member. The torsion spring has a first leg and a second leg, wherein the first leg is inserted into the first insertion hole of the lock cylinder, and the second leg is inserted into the second insertion hole of the rotary member.

A rod has a protrusion extending from the top end thereof. The protrusion is located in the bottom room of the lock cylinder. The protrusion has a radial passage which is located corresponding to the second aperture of the rotary member. The fixing pin extends through the radial passage of the rod. The rod has two notches defined in the outside thereof. The two notches are located close to the bottom end of the rod. A top member is connected to the top end of the top part and has a bore through which the head of the movable member extends. A chain has a first end and a second end. The first end of the chain is secured in the first radial slot of the top part. The second end of the chain is inserted into the second radial slot of the bottom part.

Preferably, the top part has two first threaded holes defined in the top end thereof. The top member has two first through holes. Two bolts extend through the two first through holes and are connected to the two first threaded holes.

Preferably, the bottom part has two second threaded holes defined in the bottom end thereof. The bottom member has two second through holes. Two bolts extend through the two second through holes and are connected to the two second threaded holes.

The advantages of the present invention are that the top part is pivotably connected to the bottom part so that the chain can be easily connected to the bottom part from any angle. By the rotary member and the torsion spring, the chain lock can be locked without using a key.

The present invention will become more obvious from the following description when taken in connection with the accompanying drawings which show, for purposes of illustration only, a preferred embodiment in accordance with the present invention.

DETAILED DESCRIPTION OF THE INVENTION

Figure 1:
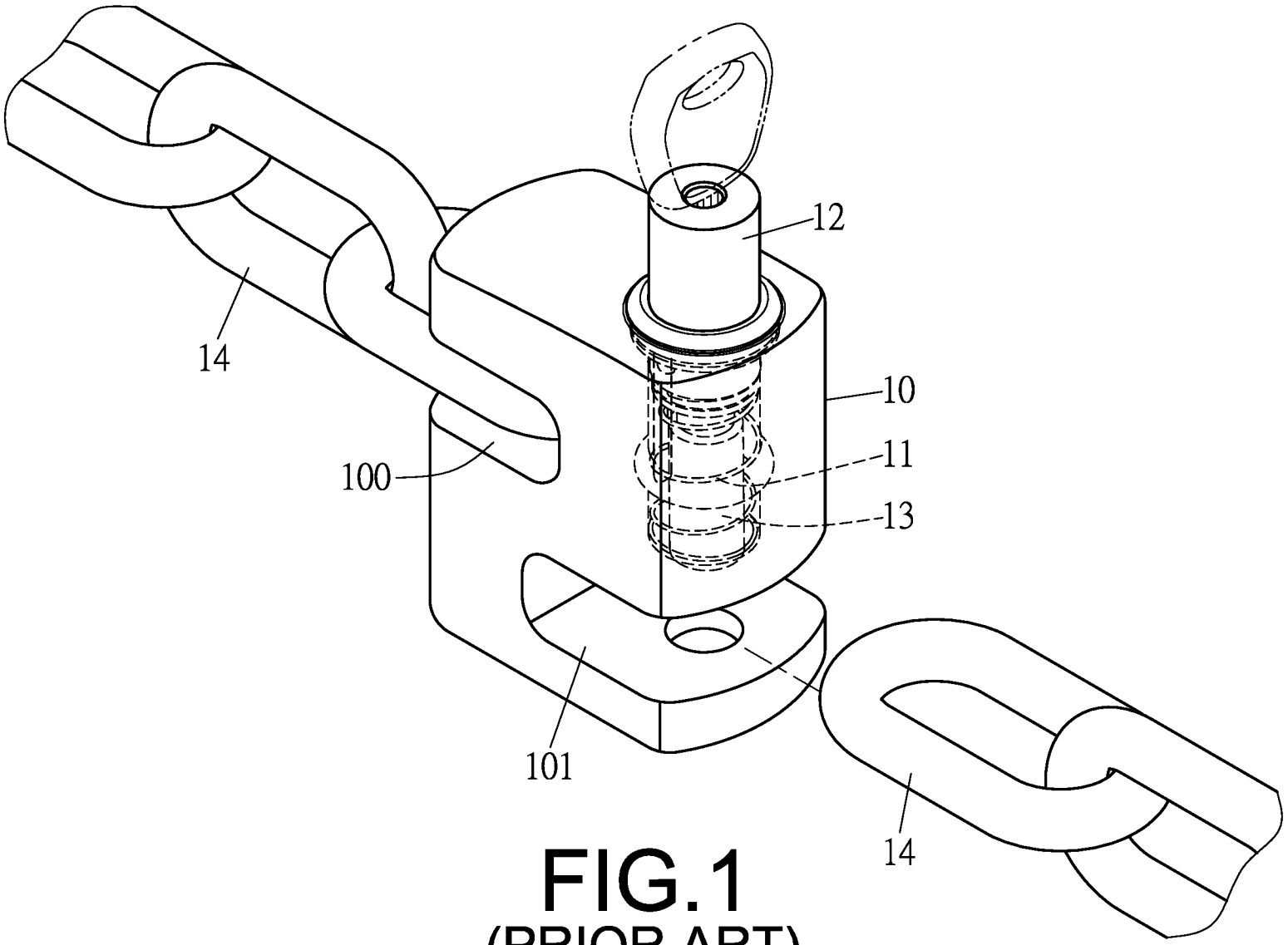
FIG.1 (PRIOR ART)
FIG. 1 illustrates a conventional chain lock.
Figure 2:
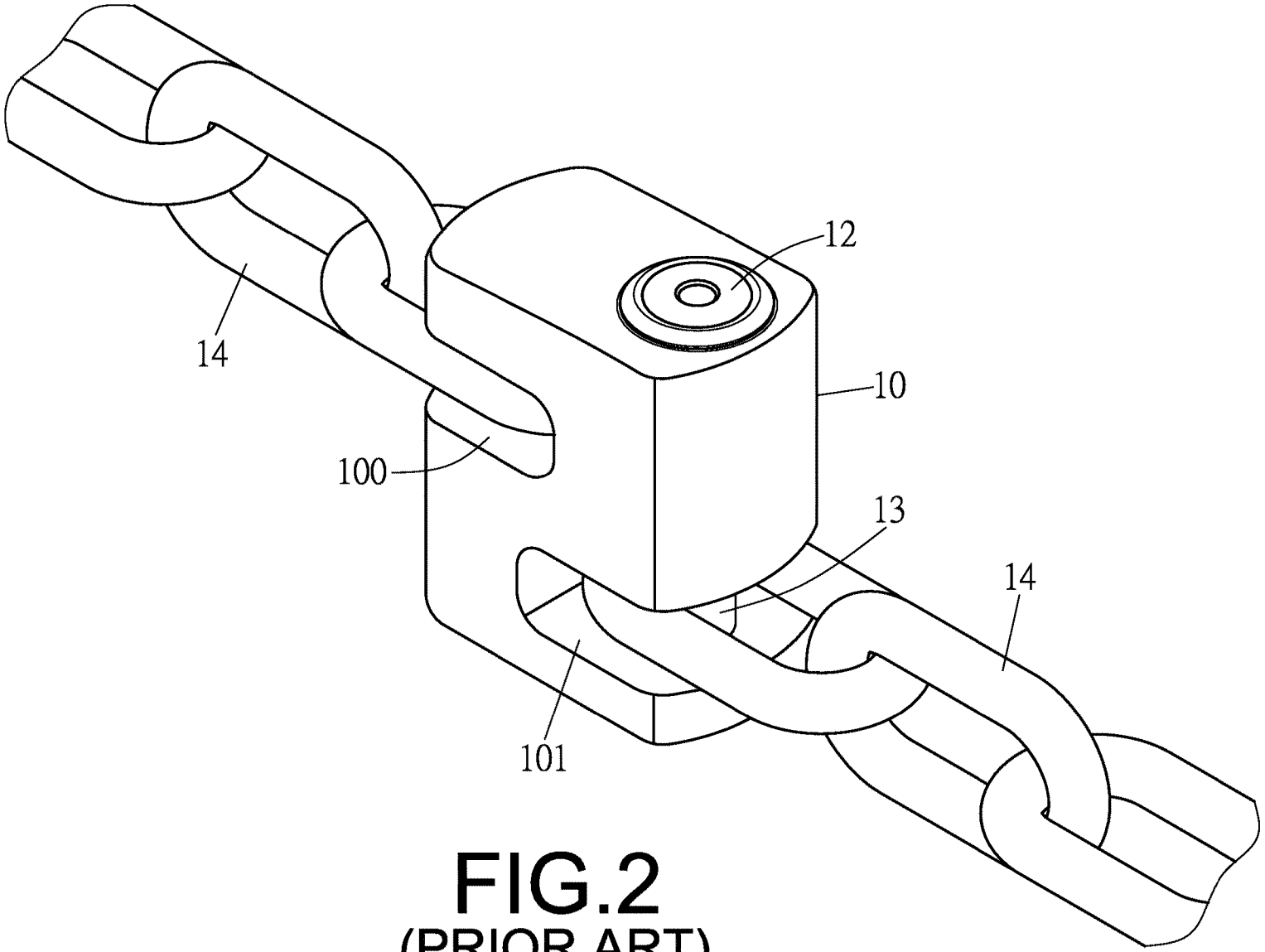
FIG.2 (PRIOR ART)
FIG. 2 illustrates that conventional chain lock is in locked status.
Figure 3:
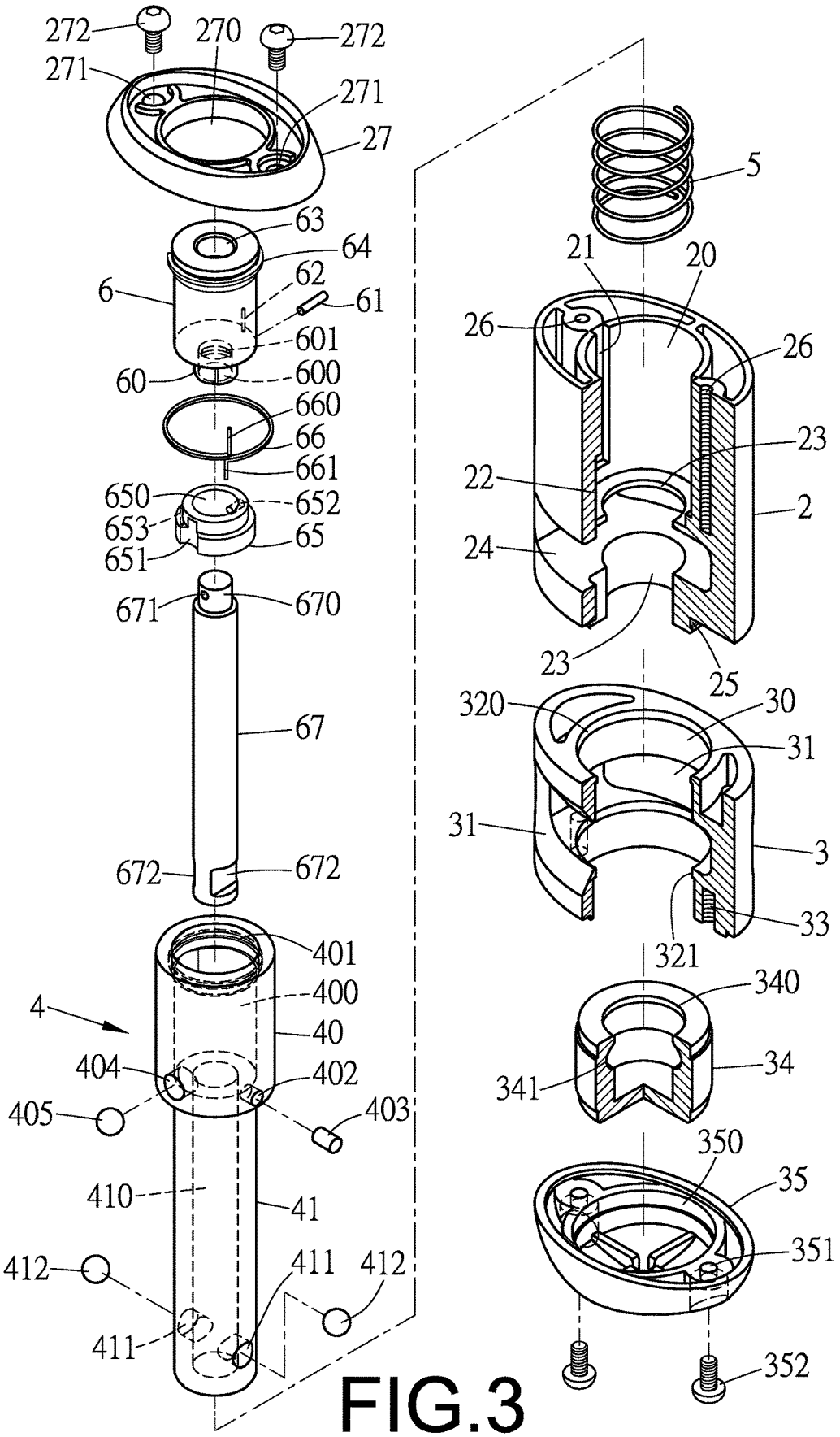
FIG. 3 is an exploded view of the chain lock of the present invention.
Figure 4:
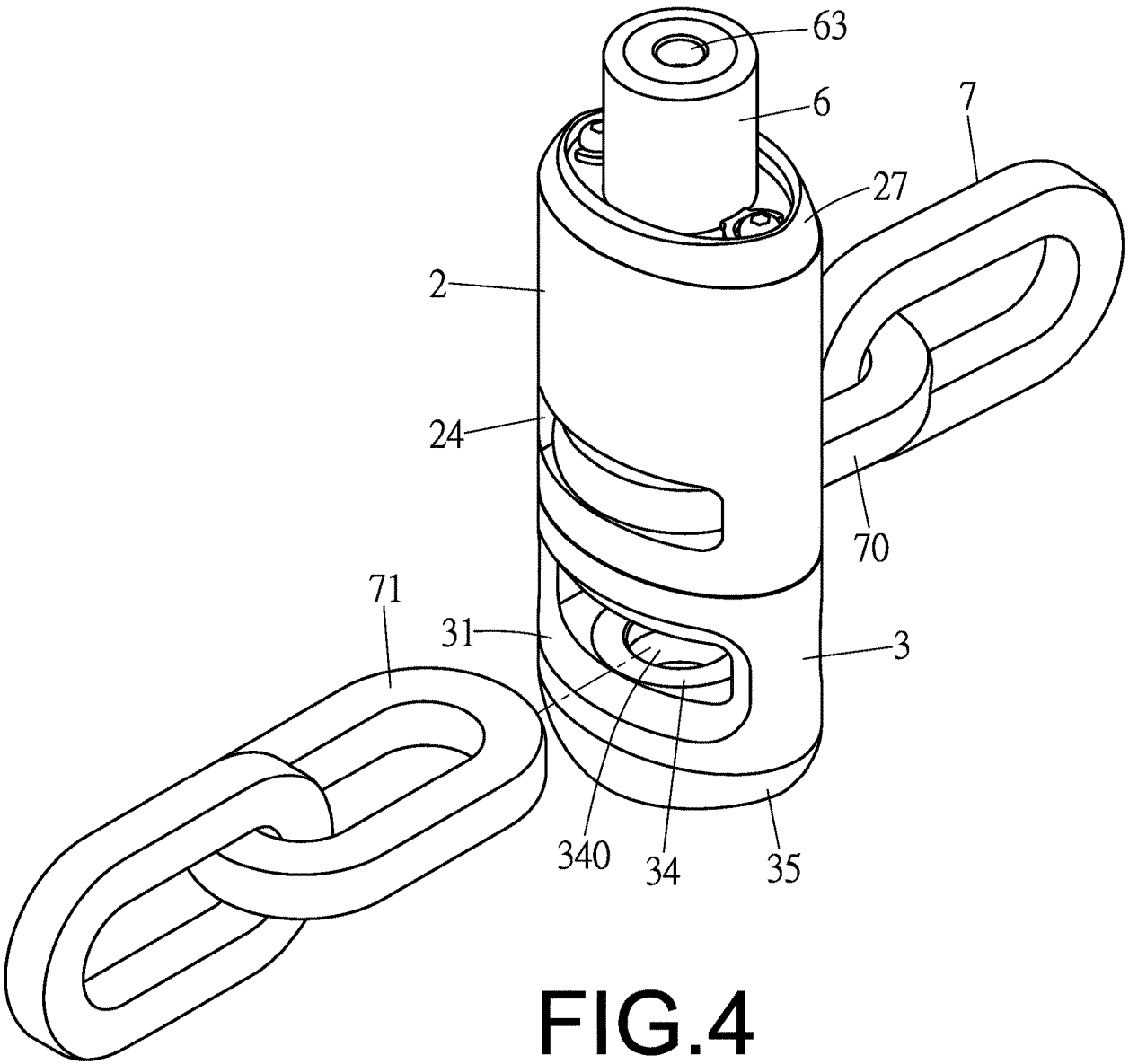
FIG. 4 is a perspective view to show the chain lock of the present invention.
Figure 5:
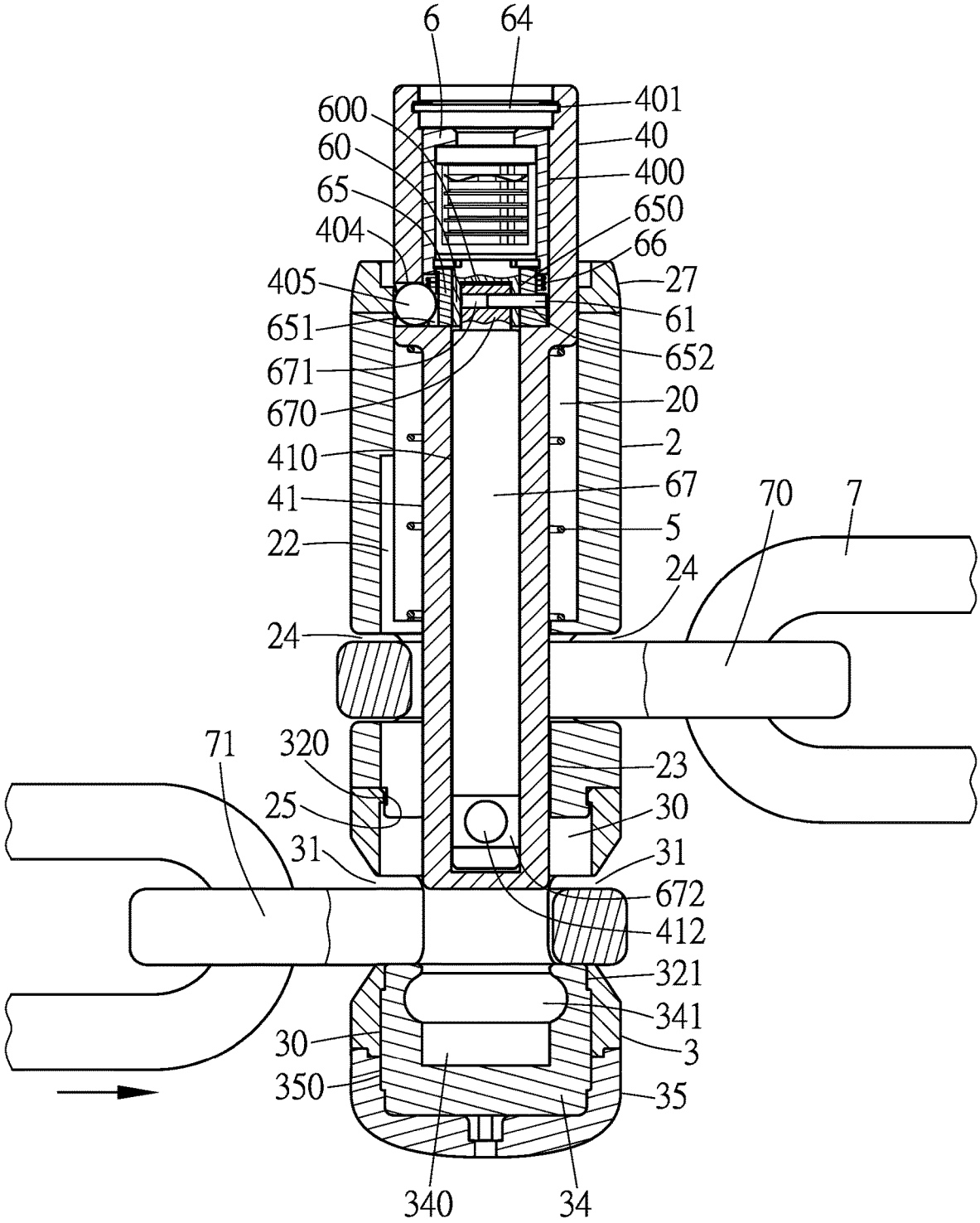
FIG. 5 is a cross sectional view to show that the chain is to be secured in the second radial slot of the bottom part of the chain lock of the present invention.

Referring to FIGS. 3 to 5, the chain lock of the present invention comprises a top part 2 having a room 20 defined in the top end thereof. At least one guide slot 21 and at least one positioning slot 22 are respectively defined axially in the inner periphery of the room 20. A bottom hole 23 is defined in a bottom end of the top part 2 and communicates with the room 20. A first radial slot 24 is defined through the wall of the top part 2 and communicates with the bottom hole 23. A flange 25 is formed to the bottom end of the top part 2. The top part 2 has two first threaded holes 26 defined in the top end thereof.

A bottom part 3 is pivotably connected to the bottom end of the top part 2. A passage 30 is defined axially through the bottom part 3. A second radial slot 31 is defined through the wall of the bottom part 3 and communicates with the passage 30. A rib 320 is formed to the top end of the bottom part 3. The flange 25 of the top part 2 is engaged with the rib 320. A lip 321 extends radially and inward from the inner periphery of the passage 30 and is located corresponding to the inside of the second radial slot 31. The bottom part 3 has two second threaded holes 33 defined in the bottom end thereof.

An engaging member 34 is located in the passage 30 of the bottom part 3 and has a recess 340 defined in the top thereof. A first annular groove 341 is defined in the inner periphery of the recess 340. A bottom member 35 is connected to the bottom end of the bottom part 3. The bottom member 35 has a reception area 350 defined in the top thereof. The bottom member 35 has two second through holes 351. Two bolts 352 extend through the two second through holes 351 and are connected to the two second threaded holes 33.

A movable member 4 is located in the room 20 of the top part 2 and extends through the bottom hole 23 and the passage 30. The movable member 4 has a head 40 and a tubular portion 41 which extends from the head 40. The head 40 has a chamber 400 defined in the top end thereof. A second annular groove 401 is defined in the inner periphery of the chamber 400. A first aperture 402 and a first radial hole 404 are defined through the wall of the head 40. A positioning pin 403 is inserted in the first aperture 402. A first bead 405 is located in the first radial hole 404. The tubular portion 41 has an axial hole 410 defined therein which communicates with the chamber 400. Two second radial holes 411 are defined through the wall of the tubular portion 41 and communicate with the axial hole 410. Two second beads 412 are respectively located in the two second radial holes 411.

A compression spring 5 is mounted to the tubular portion 41 of the movable member 4 and located in the room 20 of the top part 2. A lock cylinder 6 is located in the chamber 400 of the tubular portion 41 of the movable member 4. A driving portion 60 extends from the bottom end of the lock cylinder 6, and a bottom room 600 is defined in the bottom end of the driving portion 60. An elongate hole 601 is defined radially through the wall of the driving portion 60. A fixing pin 61 is inserted into the elongate hole 601. The lock cylinder 6 has a first insertion hole 62 defined in the bottom end thereof. A keyhole 63 is defined in the top end of the lock cylinder 6, and a C-clip 64 is mounted to the outside of the lock cylinder 6.

A rotary member 65 is a stepped member and attached to the bottom end of the lock cylinder 6. An axial hole 650 is defined in the rotary member 65 and the driving portion 60 of the lock cylinder 6 is inserted in the axial hole 650. The rotary member 65 has a curved recess 651 defined in the outside thereof. A second aperture 652 is defined radially through the wall of the rotary member 65 and communicates with the axial hole 650. The fixing pin 61 extends through the second aperture 652. A second insertion hole 653 is defined axially in the rotary member 65. A torsion spring 66 is located between the lock cylinder 6 and the rotary member 65. The torsion spring 66 has a first leg 660 and a second leg 661. The first leg 660 is inserted into the first insertion hole 62 of the lock cylinder 6, and the second leg 661 is inserted into the second insertion hole 653 of the rotary member 65.

A rod 67 has a protrusion 670 extending from the top end thereof. The protrusion 670 is located in the bottom room 600 of the lock cylinder 6.

The protrusion 670 has a radial passage 671 which is located corresponding to the second aperture 652 of the rotary member 65. The fixing pin 61 extends through the radial passage 671 of the rod 67. The rod 67 has two notches 672 defined in the outside thereof. The two notches 672 are located close to the bottom end of the rod 67. A top member 27 is connected to the top end of the top part 2 and has a bore 270 through which the head 40 of the movable member 4 extends. The top member 27 has two first through holes 271. Two bolts 272 extend through the two first through holes 271 and are connected to the two first threaded holes 26. A chain 7 has a first end 70 and a second end 71. The first end 70 of the chain 7 is secured in the first radial slot 24 of the top part 2. The second end 71 of the chain 7 can be inserted into the second radial slot 31 of the bottom part 3.

Figure 6:
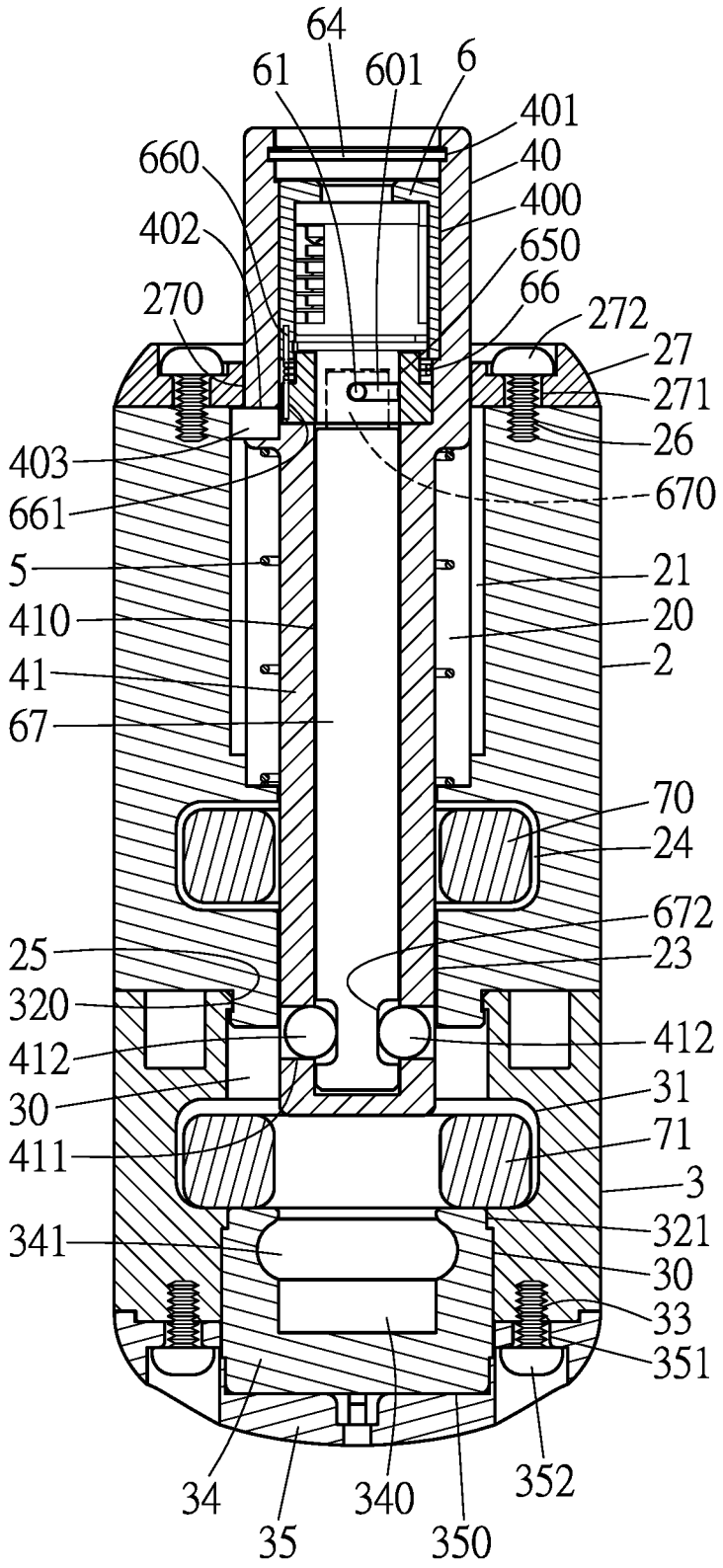
FIG. 6 is another cross sectional view of the status in FIG. 5.

As shown in FIGS. 3 to 6, when assembling the chain lock, the engaging member 34 is located in the passage 30 of the bottom part 3, and the engaging member 34 is positioned by the lip 321. The bottom member 35 is then connected to the bottom end of the bottom part 3 to accommodate the bottom end of the engaging member 34 in the reception area 350 of the bottom member 35. The bolts 352 extend through the second through holes 351 and are connected to the second threaded hole 33 of the bottom part 3 to secure the engaging member 34 in the passage 30 of the bottom part 3. The bottom member 35 is fixed to the bottom end of the bottom part 3. The top part 2 is pivotably connected to the top end of the bottom part 3 by the engagement between the flange 25 and the rib 320 as shown in FIGS. 5 and 6. The first leg 660 of the torsion spring 66 is inserted into the first insertion hole 62 of the lock cylinder 6, and the second leg 661 of the torsion spring 66 is inserted into the second insertion hole 653 of the rotary member 65, so that the torsion spring 66 is biased between the lock cylinder 6 and the rotary member 65. The driving portion 60 of the lock cylinder 6 is inserted into the axial hole 650 of the rotary member 65. The protrusion 670 of the rod 67 is inserted into the bottom room 600 of the lock cylinder 6. The fixing pin 61 is inserted into the elongate hole 601 of the lock cylinder 6, the second aperture 652 of the rotary member 65 and the radial passage 671 of the rod 67 to combine the lock cylinder 6, the rotary member 65 and the rod 67 together. The lock cylinder 6, the rotary member 65, the torsion spring 66 and the rod 67 are installed in the chamber 400 and the axial hole 410. The C-clip 64 of the lock cylinder 6 is engaged with the second annular groove 401 of the movable member 4 to prevent the lock cylinder 6, the rotary member 65, the torsion spring 66 and the rod 67 from being dropping out from the movable member 4. The lock cylinder 6, the torsion spring 66 and the rotary member 65 are located in the chamber 400, and the positioning pin 403 is inserted into the first aperture 402. The curved recess 651 of the rotary member 65 is located corresponding to the first radial hole 404 of the head 40 of the movable member 4. The first bead 405 is engaged with the first radial hole 404 of the head 40 of the movable member 4. A portion of the first bead 405 is located in the curved recess 651 of the rotary member 65. The torsion spring 66 is twisted by the lock cylinder 6 and the rotary member 65, and the two second beads 412 are respectively located in the second radial holes 411. The notches 672 of the rod 67 are located corresponding to the second radial holes 411, so that a portion of each second bead 412 is located in the notch 672 corresponding thereto. The compression spring 5 is mounted to the tubular portion 41 of the movable member 4. The first end 70 of the chain 7 is secured in the first radial slot 24 of the top part 2. The movable member 4 is inserted in the room 20 and the bottom hole 23 of the top part 2. The compressing spring 5 is biased between the bottom end of the head 40 of the movable member 4 and the inner end of the room 20. The positioning pin 403 of the head 40 has a portion thereof is located in the guide slot 21 of the top part 2 so that the movable member 4 cannot rotate relative to the top part 2, and the movable member 4 can only move axially relative to the top part 2. The tubular portion 41 of the movable member 4 extends through bottom hole 23 of the top part 2 and the first end 70 of the chain 7 to secure the first end 70 of the chain 7 to the first radial slot 24. The top member 27 is connected to the top end of the top part 2. The two bolts 272 extend through the two first through holes 271 and are connected to the two first threaded holes 26. The head 40 of the movable member 4 protrudes from the bore 270 of the top member 27.

Figure 7:
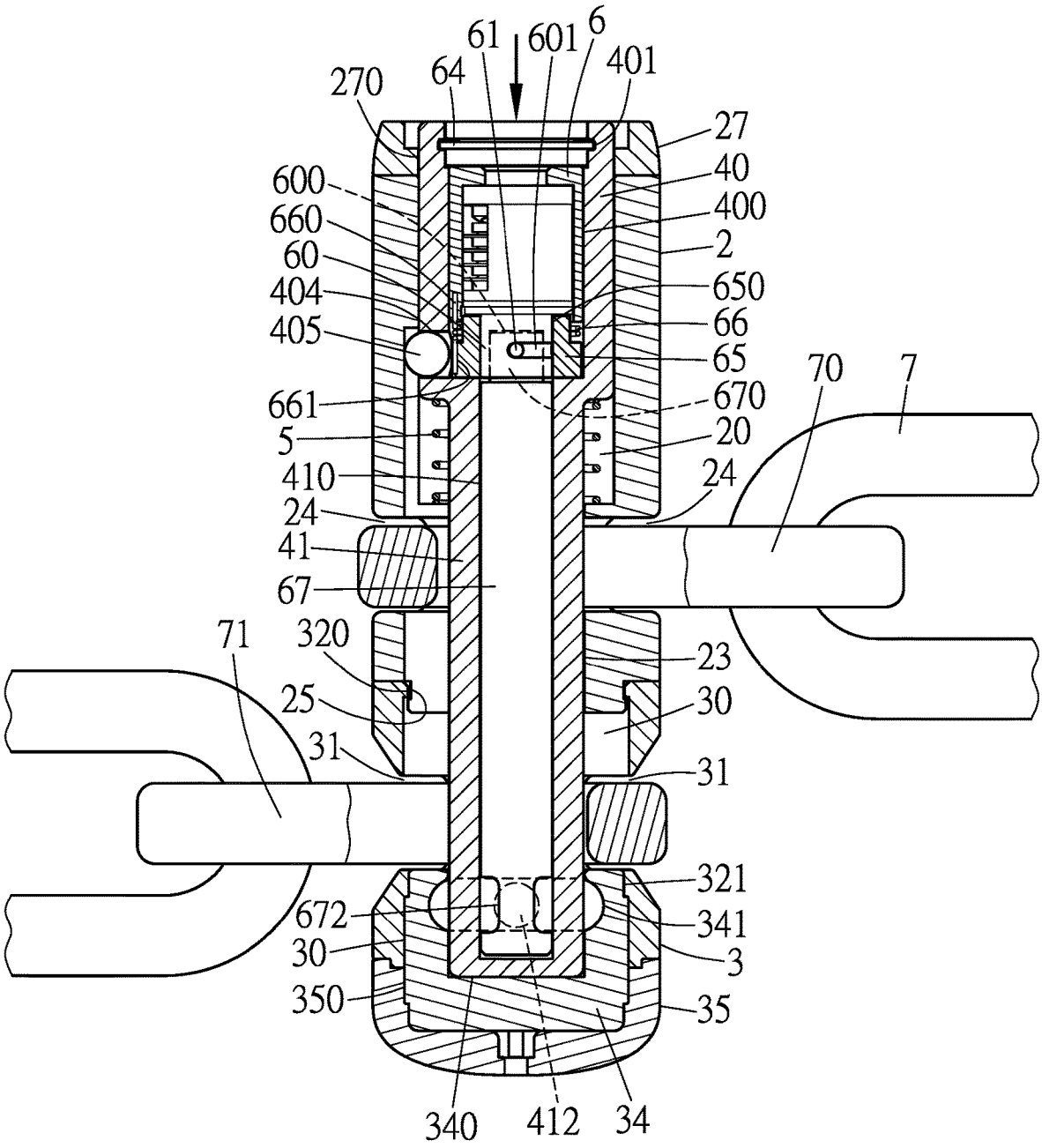
FIG. 7 is a cross sectional view to show that the chain is secured in the second radial slot of the bottom part of the chain lock of the present invention.
Figure 8:
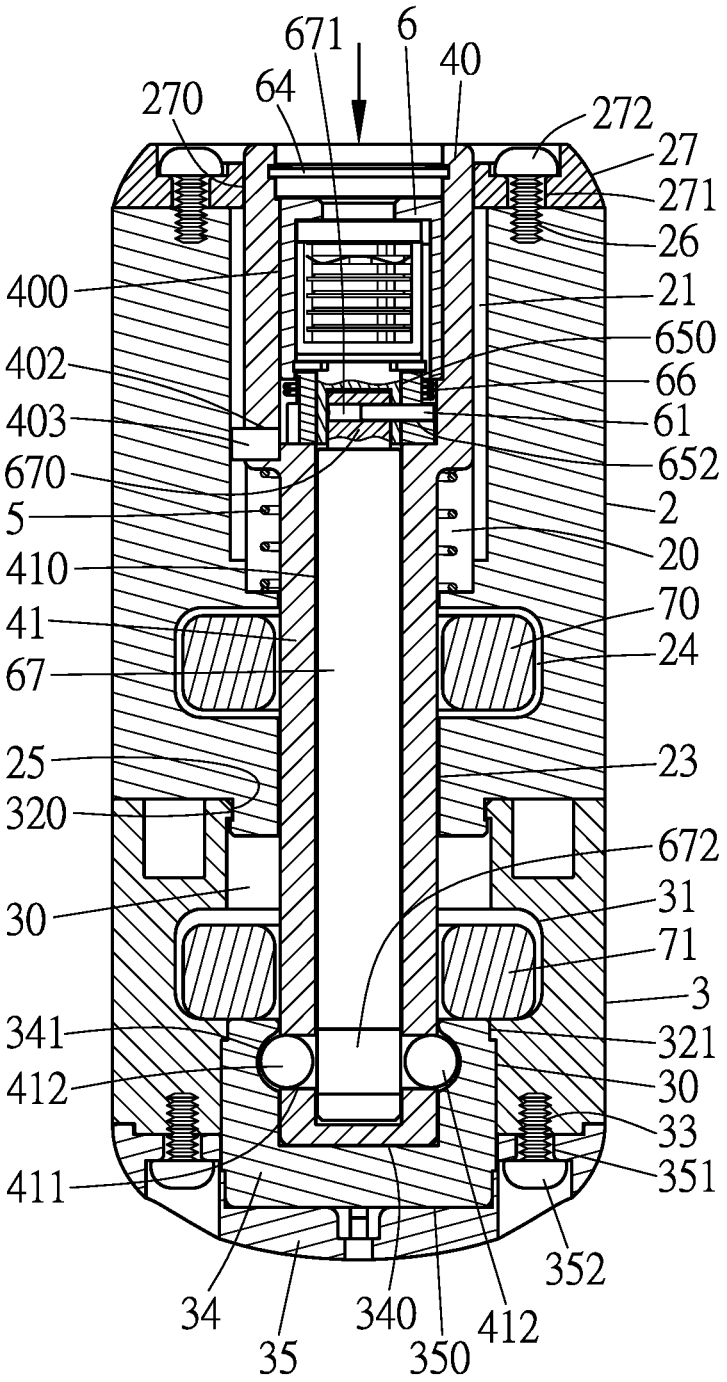
FIG. 8 is another cross sectional view of the status in FIG. 7.
Figure 9:
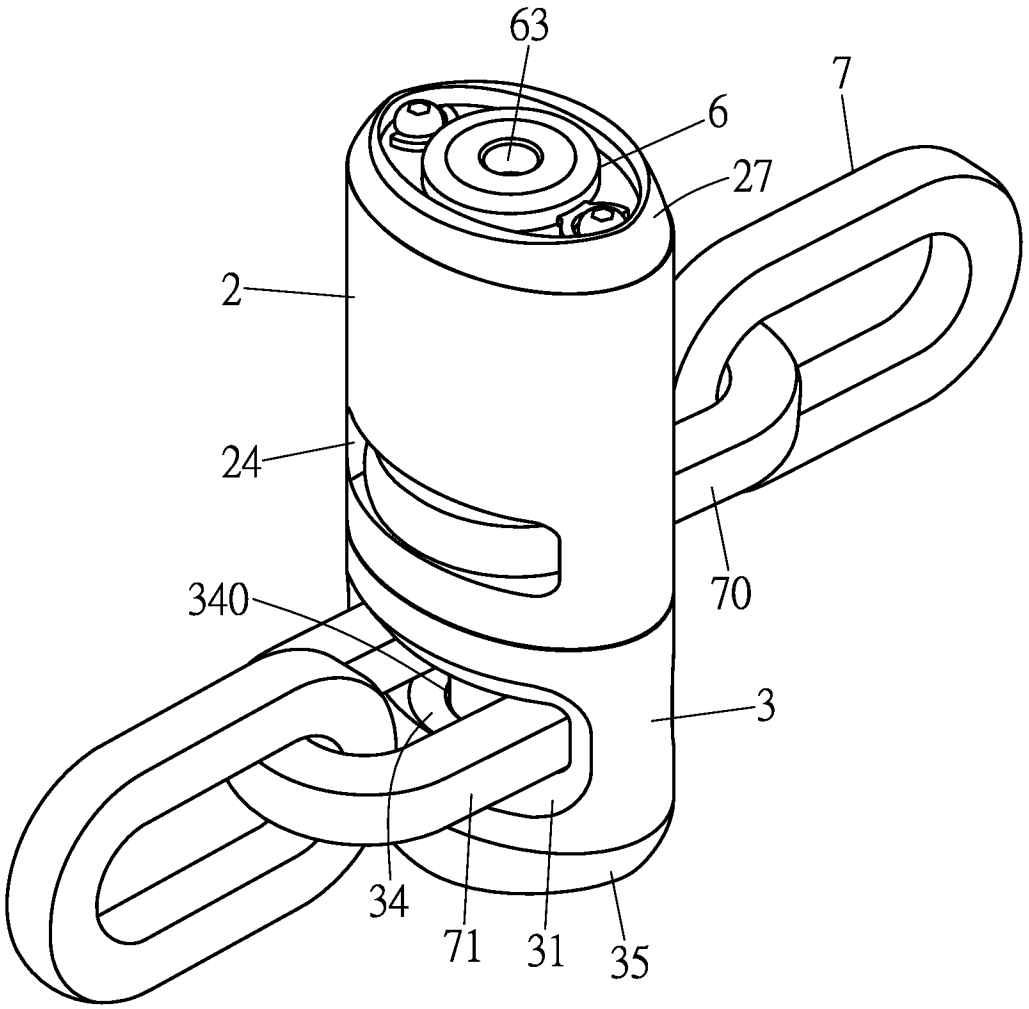
FIG. 9 is a perspective view to show that the chain lock of the present invention is locked.
Figure 10:
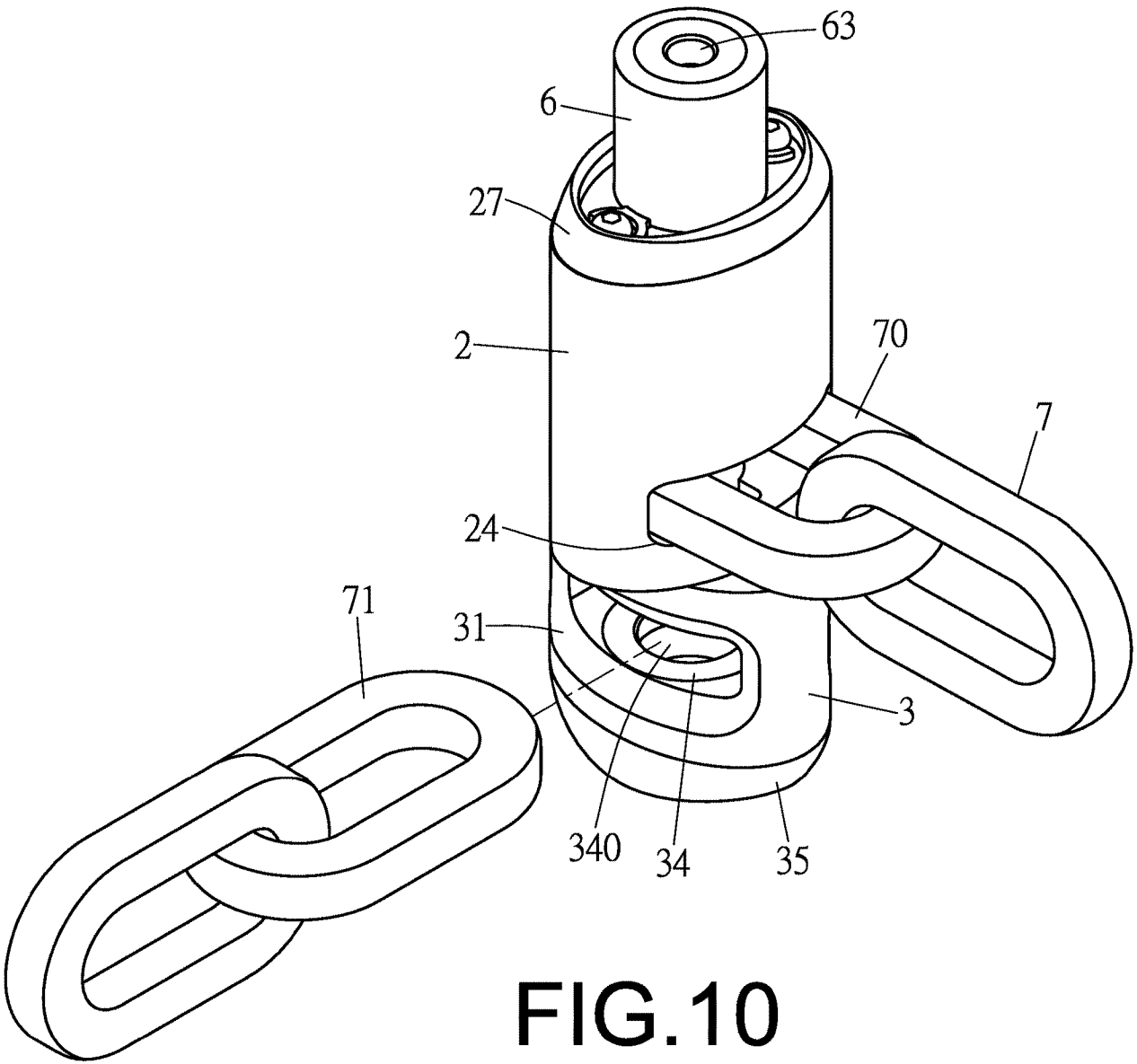
FIG. 10 shows that the bottom part is rotated an angle relative to the top part.

As shown in FIGS. 4 to 10, when in use, the second end 71 of the chain 7 extends through the object (such as the bicycle wheel) to be secured, and is inserted into the second radial slot 31 of the bottom part 3. The second end 71 of the chain 7 is located corresponding to the bottom hole 23 of the top part 2 and the recess 340 of the engaging member 34 in the bottom part 3 as shown in FIGS. 4 to 6. The portion of the head 40 that protrudes beyond the top part 2 is pressed into the top part 2 as shown in FIGS. 7 to 9. The movable member 4 is moved toward inside of the top part 2, and the positioning pin 403 of the movable member 4 is moved along the guide slot 21 of the top part 2, and the first bead 405 is moved with the movable member 4. When the first bead 405 moves to the positioning slot 22 of the top part 2, the first bead 405 is not pushed by the wall of the room 20 of the top part 2, so that the first bead 405 is moved into the positioning slot 22 of the top part 2, and is not located in the curved recess 651 of the rotary member 65. The recovery force of the torsion spring 66 rotates the rotary member 65 back and the wall of the rotary member 65 pushes the first bead 405 outward so that a portion of the first bead 405 protrudes into the positioning slot 22 of the top part 2. The movable member 4 moves toward the top part 2 and compresses and holds the compression spring 5. The lower end of the tubular portion 41 of the movable member 4 in the bottom hole 23 of the top part 2 extends through the second end 71 of the chain 7 and is inserted into the recess 340 of the engaging member 34 in the bottom part 3. The second beads 412 on the movable member 4 are located corresponding to the first annular groove 341 of the engaging member 34. Along with the rotation of the rotary member 65 by the torsion spring 66, the rod 67 is rotated, and the notches 672 of the rod 67 are moved away from the second radial hole 411. The rod 67 push the second beads 412 outward so that a portion of each second bead 412 protrudes beyond the movable member 4 and is engaged with the first annular groove 341 of the engaging member 34 as shown in FIG. 8. Therefore, the chain lock is conveniently locked without using any key. The first end 70 of the chain 7 is secured to the first radial slot 24 by the movable member 4 reduces the volume of the chain lock in radial direction. By the positioning of second beads 412, and the insertion of the movable member 4, the second end 71 of the chain 7 is inserted into the second radial slot 31 of the bottom part 3 to have better anti-theft feature as shown in FIGS. 7 and 8. Because the bottom part 3 is pivotable relative to the top part 2, so that the second radial slot 31 of the bottom part 3 and the first radial slot 24 of the top part 2 can be arranged to desired angular positions as shown in FIGS. 9 and 10, such that the users can easily and conveniently lock the chain lock.

When unlocking the chain lock, the correct key is inserted into the keyhole 63 of the lock cylinder 6 and rotates the driving portion 60 of the lock cylinder 6, the driving portion 60 of the lock cylinder 6 drives the rotary member 65 and the rod 67, and twists the torsion spring 66. The notches 672 of the rod 67 are moved to be aligned with the second radial holes 411. The second beads 412 are not pushed by the rod 67 so that the second beads 412 removed from the first annular groove 341 and move into the second radial holes 411 and the notches 672 of the rod 67. The curved recess 651 of the rotary member 65 is again in alignment with the first radial hole 404 of the movable member 4, and the first bead 405 is not located in the positioning slot 22 and moves into the curved recess 651. The compression spring 5 in the room 20 of the top part 2 pushes the movable member 4 upward as shown in FIG. 5, so that the head 40 protrudes beyond the top member 27. The movable member 4 is pushes upward by the compression spring 5 and is separated from bottom part 3, the recess 340 of the engaging member 34 and the second end 71 of the chain 7. Therefore, the second end 71 of the chain 7 can be removed from the second radial slot 31 of the bottom part 3 to unlock the chain lock.

While we have shown and described the embodiment in accordance with the present invention, it should be clear to those skilled in the art that further embodiments may be made without departing from the scope of the present invention.

What is claimed is:

1. A chain lock comprising:

a top part having a room defined in a top end thereof, at least one guide slot and at least one positioning slot respectively defined axially in an inner periphery of the room, a bottom hole defined in a bottom end of the top part and communicating with the room, a first radial slot defined through a wall of the top part and communicating with the bottom hole, a flange formed to the bottom end of the top part;

a bottom part pivotably connected to the bottom end of the top part, a passage defined axially through the bottom part, a second radial slot defined through a wall of the bottom part and communicating with the passage, a rib formed to a top end of the bottom part, the flange of the top part engaged with the rib, a lip extending radially and inward from an inner periphery of the passage and located corresponding to an inside of the second radial slot;

an engaging member located in the passage of the bottom part and having a recess defined in a top thereof, a first annular groove defined in an inner periphery of the recess;

a bottom member connected to a bottom end of the bottom part, the bottom member having a reception area defined in a top thereof;

a movable member located in the room of the top part and extending through the bottom hole and the passage, the movable member having a head and a tubular portion which extends from the head, the head having a chamber defined in a top end thereof, a second annular groove defined in an inner periphery of the chamber, a first aperture and a first radial hole defined through a wall of the head, a positioning pin inserted in the first aperture, a first bead located in the first radial hole, the tubular portion having an axial hole defined therein which communicates with the chamber, two second radial holes defined through a wall of the tubular portion and communicating with the axial hole, two second beads respectively located in the two second radial holes;

a compression spring mounted to the tubular portion of the movable member and located in the room of the top part;

a lock cylinder located in the chamber of the head of the movable member, a driving portion extending from a bottom end of the lock cylinder and a bottom room defined in a bottom end of the driving portion, an elongate hole defined radially through a wall of the driving portion, a fixing pin inserted into the elongate hole, the lock cylinder having a first insertion hole defined in the bottom end thereof, a keyhole defined in a top end of the lock cylinder, a C-clip mounted to an outside of the lock cylinder;

a rotary member attached to the bottom end of the lock cylinder and having an axial hole in which the driving portion of the lock cylinder is inserted, the rotary member having a curved recess defined in an outside thereof, a second aperture defined radially through a wall of the rotary member and communicating with the axial hole, the fixing pin extending through the second aperture, a second insertion hole defined axially in the rotary member;

a torsion spring located between the lock cylinder and the rotary member, the torsion spring having a first leg and a second leg, the first leg inserted into the first insertion hole of the lock cylinder, the second leg inserted into the second insertion hole of the rotary member;

a rod having a protrusion extending from a top end thereof, the protrusion located in the bottom room of the lock cylinder, the protrusion having a radial passage which is located corresponding to the second aperture of the rotary member, the fixing pin extending through the radial passage of the rod, the rod having two notches defined in an outside thereof, the two notches located close to the bottom end of the rod;

a top member connected to the top end of the top part and having a bore through which the head of the movable member extends, and a chain having a first end and a second end, the first end of the chain secured in the first radial slot of the top part, the second end of the chain inserted into the second radial slot of the bottom part.

2. The chain lock as claimed in claim 1, wherein the top part has two first threaded holes defined in the top end thereof, the top member has two first through holes, two bolts extend through the two first through holes and are connected to the two first threaded holes.

3. The chain lock as claimed in claim 1, wherein the bottom part has two second threaded holes defined in the bottom end thereof, the bottom member has two second through holes, two bolts extend through the two second through holes and are connected to the two second threaded holes.

* * * * *